US005868566A

United States Patent [19]

Johnson et al.

[11] Patent Number: 5,868,566

[45] Date of Patent: Feb. 9, 1999

[54] SEALED AND ZONE ROTARY GRATE CONVECTION SOLIDS PROCESSING APPARATUS

[75] Inventors: Beverly Earl Johnson, Pittsburgh; James P. Docherty, Carnegie, both of Pa.

[73] Assignee: Techint Technologies Inc., Coraopolis, Pa.

[21] Appl. No.: 941,937

[22] Filed: Oct. 1, 1997

[51] Int. Cl.[6] ..... F27B 9/16

[52] U.S. Cl. ..... 432/138; 432/139; 110/247

[58] Field of Search ..... 432/96, 99, 102, 432/111, 138, 139; 110/247

[56] References Cited

U.S. PATENT DOCUMENTS

| | | | |
|---|---|---|---|
| 2,525,407 | 10/1950 | Frei, Jr. | 432/138 |
| 3,219,327 | 11/1965 | Guingand | 432/138 |
| 4,412,813 | 11/1983 | Wulf | 432/11 |
| 4,669,977 | 6/1987 | Johnson et al. | 432/481 |
| 4,818,222 | 4/1989 | Docherty et al. | 432/138 |
| 4,834,650 | 5/1989 | Docherty et al. | 432/138 |
| 5,173,047 | 12/1992 | Shefsiek | 432/138 |

*Primary Examiner*—Teresa J. Walberg
*Assistant Examiner*—Gregory A. Wilson
*Attorney, Agent, or Firm*—Webb Ziesenheim Bruening Logsdon Orkin & Hanson, P.C.

[57] ABSTRACT

A rotary hearth furnace includes a base having a plurality of first plenums, an upper chamber having a plurality of second plenums and a hearth rotatable between the base and the upper chamber and having a plurality of third plenums. The hearth is moveable between the base and the upper chamber so that two or more of the third plenums are positionable to receive gas exhausted by one of the first plenums and to discharge the received gas into one of the second plenums.

23 Claims, 12 Drawing Sheets

SEALED AND ZONE ROTARY GRATE CONVECTION SOLIDS PROCESSING APPARATUS

FIELD OF THE INVENTION

This invention relates to rotary furnaces for drying and heating particulate materials such as coal, coke, grain and the like in a controlled atmosphere. It is more particularly concerned with a rotary furnace which enables continuous processing of particulate material in a plurality of different atmospheres.

DESCRIPTION OF THE PRIOR ART

Sealed rotary furnaces have long been used for drying or pyrolyzing various materials such as coke, coal or other aggregates. In a particular rotary furnace, externally generated hot gases are introduced into a lower furnace chamber and rise through a rotating perforated hearth, thereby heating materials carried on the hearth.

Heretofore, the design of rotary hearth furnaces enabled only one source of hot gas to be utilized to treat or heat the materials on the hearth. If it was desired to treat the material utilizing more than one type of gas, it became necessary to remove the material from one rotating hearth furnace and transfer it to another rotating hearth furnace. Alternatively, the furnace was purged of one gas and a second gas was introduced thereinto. It is desirable, however, to be able to continuously process material on the hearth utilizing two or more different gases.

It is therefore an object of the present invention to provide a rotary hearth furnace wherein material on the hearth can be sequentially exposed to different gases. It is a further object of the present invention to impede commingling of the gases in such a furnace.

SUMMARY OF THE INVENTION

In accordance with the present invention, a furnace for drying and heating particulate material includes a base having a plurality of first plenums, an upper chamber having a plurality of second plenums, and a hearth positioned between the base and the upper chamber and moveable therebetween. Each of the first plenums has a gas inlet and a gas outlet and each of the second plenums is aligned to receive gas from the gas outlet of one of the first plenums. The hearth includes a grate and a plurality of third plenums positioned between the grate and the first plenums. The grate defines an exhaust opening for each of the third plenums wherein two adjacent third plenums are positionable to receive gas from the gas outlet of one of the first plenums and to exhaust gas through the exhaust openings thereof to the second plenum.

Each of the second plenums is defined by a pair of baffles positioned orthogonal to the direction of movement of the grate. Each baffle has a distal edge spaced from the grate a distance sufficient to permit material deposited on the grate to pass between the grate and the distal edge of the baffle. Preferably, the second plenums are in alignment with the first plenums.

In accordance with another embodiment of the invention, a moveable hearth furnace includes a first lower plenum having a gas outlet, a first upper plenum having a gas inlet and a hearth positionable between the first lower plenum and the first upper plenum and moveable therebetween. The hearth includes a grate having a surface for supporting material being processed and a pair of adjacent plenums positioned between the grate and the first lower plenum. The grate defines an opening for each plenum of the pair of adjacent plenums for exhausting gas therefrom. Each of the pair of adjacent plenums is positionable to receive gas from the gas outlet of the first lower plenum and direct the received gas to the gas inlet of the first upper plenum via the opening in the grate.

The furnace includes a second lower plenum positioned adjacent the first lower plenum and a second upper plenum positioned adjacent the first upper plenum. The second lower plenum has a gas outlet and the second upper plenum has a gas inlet. A baffle is positioned between the first lower plenum and the second lower plenum. The baffle coacts with the first lower plenum and the second lower plenum so that, as the hearth moves sequentially from fluid communication with the first lower plenum to fluid communication with the second lower plenum, each of the adjacent plenums of the hearth receives gas from the gas outlet of only one of the first lower plenum and the second lower plenum. The first lower plenum has a first gas inlet for receiving a first gas, and the second lower plenum has a second gas inlet for receiving a second gas. The first upper plenum has a first gas outlet and the second upper plenum has a second gas outlet. The first gas outlet and the second gas outlet are connected to an exhaust header.

In accordance with another embodiment of the invention, a rotary hearth furnace includes an annular gas exhaust inlet header having a first pair of concentric sidewalls and a plurality of first partitions positioned around the inlet header and extending between the first pair of sidewalls. The plurality of first partitions and the first pair of sidewalls define a first arcuate inlet zone and a second arcuate inlet zone for receiving a first gas and second gas, respectively. The first arcuate inlet zone has a first exhaust aperture and the second arcuate inlet zone has a second exhaust aperture. An annular exhaust gas header is positioned coaxial with the inlet header. The exhaust header has a second pair of concentric sidewalls and a plurality of second radially extending partitions positioned around the exhaust header and extending between the second pair of sidewalls. The plurality of second partitions and the second pair of sidewalls define a first arcuate exhaust zone and a second arcuate exhaust zone, each having an inlet aperture for receiving the first gas and the second gas, respectively. A ring-shaped hearth is positioned coaxial between the inlet header and the exhaust header and rotatable therebetween. The hearth includes a third pair of concentric sidewalls and a plurality of third radially extending partitions positioned around the hearth and extending between the third pair of sidewalls. The plurality of third partitions and the third pair of sidewalls define a plurality of intermediate arcuate zones. Each of the intermediate arcuate zones has an inlet aperture for receiving gas from one of the first exhaust aperture and the second exhaust aperture. The hearth further includes a material processing grate positioned between the plurality of intermediate arcuate zones and the gas exhaust header. The material processing grate defines an outlet aperture for each of the plurality of intermediate arcuate zones for exhausting gas into the inlet aperture of the first arcuate exhaust zone and the second arcuate exhaust zone. The plurality of intermediate arcuate zones channel the first gas between the first inlet zone and the first exhaust zone and channel the second gas between the second inlet zone and the second exhaust zone as the hearth is rotated between the inlet header and the exhaust header.

A baffle is positioned between the first arcuate inlet zone and the second arcuate inlet zone. The baffle and the plurality of arcuate zones coact to restrict the entry of gas into intermediate arcuate zones moving between the first arcuate inlet zone and the second arcuate inlet zone. The first inlet zone and the second inlet zone are axially aligned with the first exhaust zone and the second exhaust zone, respectively.

An advantage of the present invention is that material deposited on the grate can be continuously processed by two or more treatment gases without removing the material from the grate.

Another advantage of the present invention is that commingling of hot gases in minimized during processing of the material.

Still other advantages will become apparent upon reading and understanding the following detailed description.

DETAILED DESCRIPTION OF THE PREFERRED EMBODIMENTS

For convenience of description, terms such as upper, lower, horizontal, vertical, inner, outer and the like, used in the following description refer to directions relative to the apparatus shown in the accompanying drawings. These terms, however, should not be construed as restricting the scope of the claimed invention.

Figure 1:
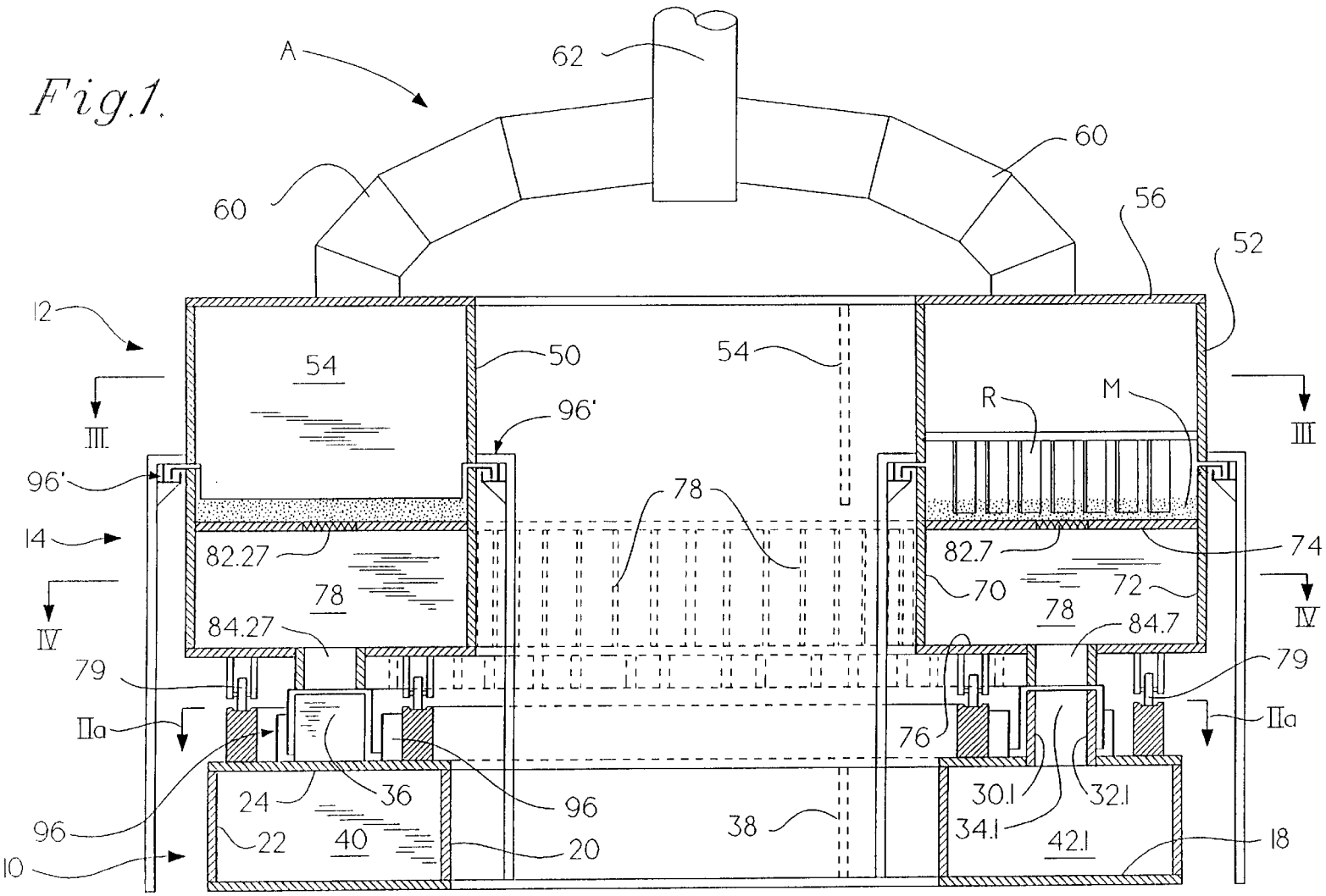
FIG. 1 is an elevational sectional view of a rotary furnace with a base defining a plurality of first plenums, an upper chamber defining a plurality of second plenums, and a rotatable hearth defining a plurality of third plenums.

With reference to FIG. 1, a sealed rotary furnace A includes a stationary base 10 and a stationary upper chamber 12 separated by a rotating hearth 14.

The base 10 has an annular floor 18, an inner cylindrical sidewall 20 affixed to an inner radial edge of the floor 18 and an outer cylindrical sidewall 22 affixed to an outer radial edge of the floor 18. The inner cylindrical sidewall 20 and the outer cylindrical sidewall 22 are concentric.

Figure 2A:
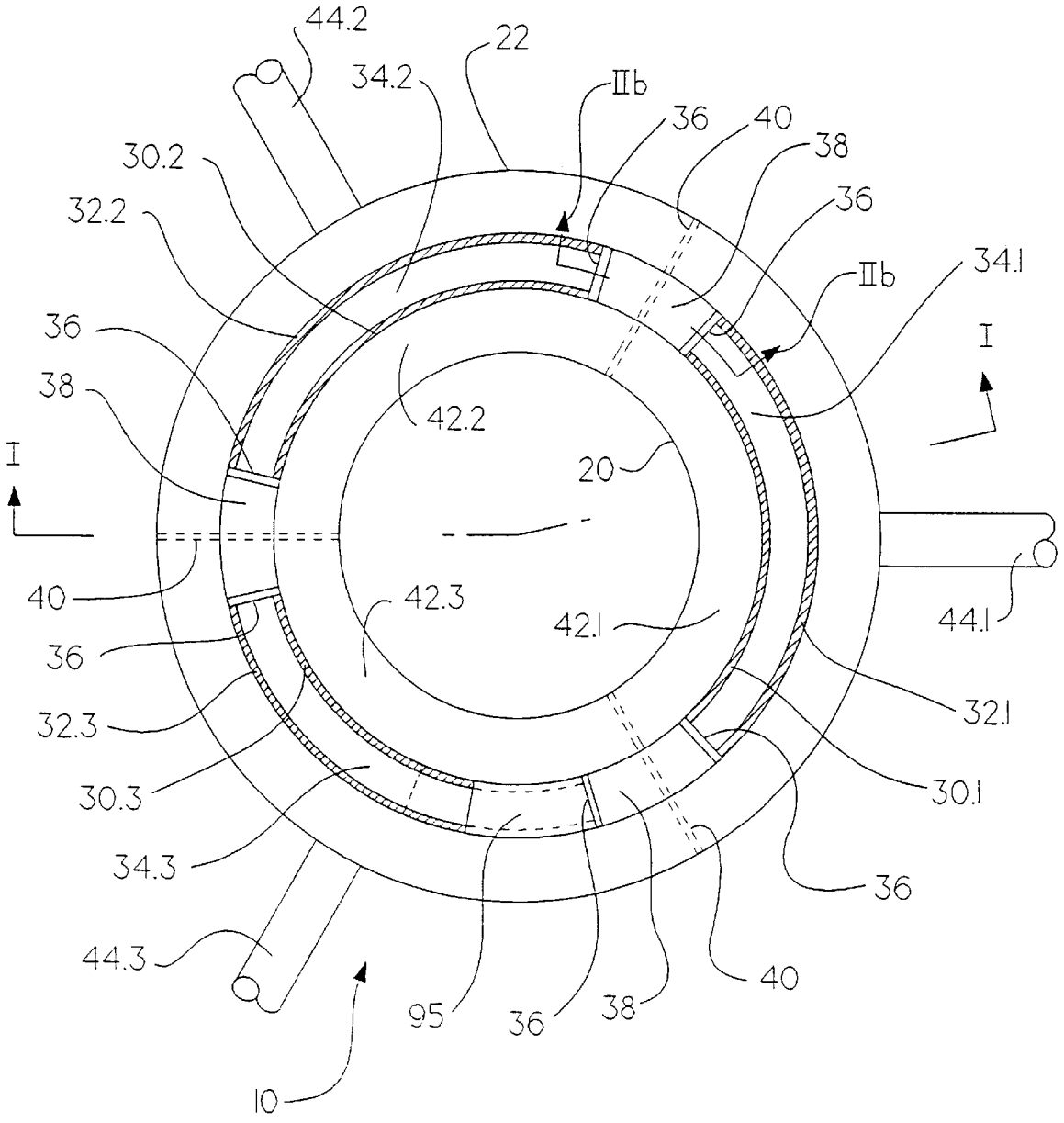
FIG. 2*a* is a plan view of the rotary hearth furnace taken along section lines II*a*—II*a* in FIG. 1.
Figure 2B:
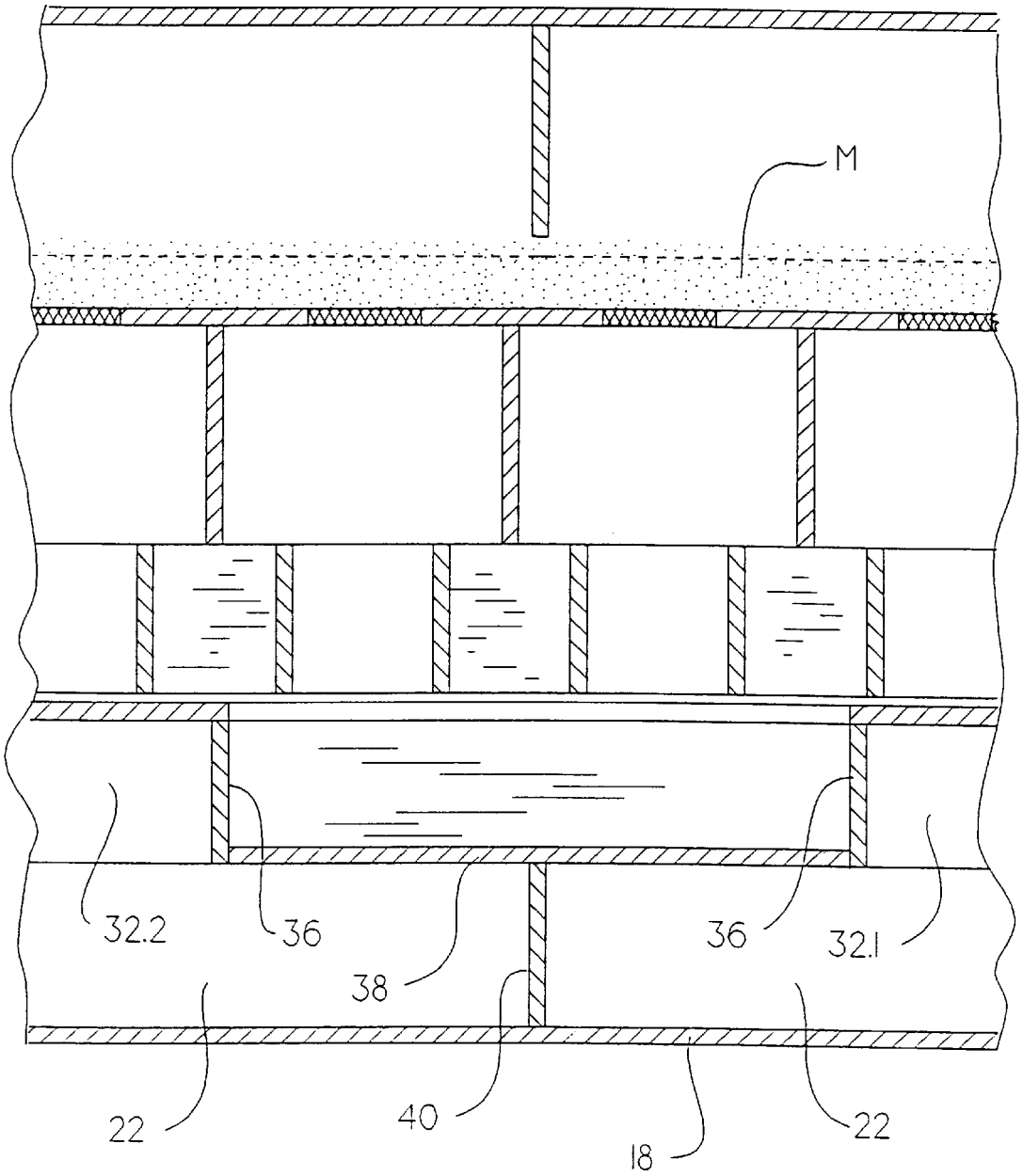
FIG. 2*b* is a plan view of the rotary hearth furnace taken along section lines II*b*—II*b* in FIG. 2*a*.

With reference to FIGS. 2*a* and 2*b* and with continuing reference to FIG. 1, the base 10 includes a roof 24 affixed between the sidewalls 20 and 22 opposite the floor 18. The roof 24 includes first or inner arcuate segments 30.1, 30.2 and 30.3 that extend upwardly from the roof 24 and second or outer arcuate segments 32.1, 32.2 and 32.3 positioned in respective opposition therewith. The opposing arcuate segments 30.1–32.1, 30.2–32.2 and 30.3–32.3 define arcuate channels 34.1, 34.2 and 34.3 therebetween. Preferably, the arcuate channels 34.1, 34.2 and 34.3 are uniformly positioned around the base.

The roof 24 includes radially and upwardly extending end plates 36 positioned at opposite ends of each arcuate channel 34.1, 34.2 and 34.3 and cover plates 38 that extend between the end plates 36 of adjacent arcuate channels 34.1, 34.2 and 34.3. The end plates 36 and the cover plates 38 are affixed in sealing engagement between adjacent arcuate exhaust channels 34.1, 34.2 and 34.3. Alternatively, the roof 24 is formed in a manner that avoids the need for cover plates 38.

Positioned around the interior of the base 10 are a plurality of first baffles 40, shown in phantom in FIG. 2*a*. Each of the first baffles 40 is positioned between adjacent arcuate channels 34.1, 34.2 and 34.3 and in sealing engagement between the sidewalls 20 and 22, the roof 24, the floor 18 and the cover plates 38. The seals formed by the plurality of first baffles 40 in the base 10 define a plurality of lower arcuate zones or plenums 42.1, 42.2 and 42.3 around the base 10.

Each of the lower arcuate plenums 42.1, 42.2 and 42.3 has a gas inlet 44.1, 44.2 and 44.3 connected to a common or separate source of heated gas (not shown) that is utilized to treat material M deposited on the hearth 14. The arcuate channels 34.1, 34.2 and 34.3 define exhaust outlets for the lower plenums 42.1, 42.2 and 42.3, respectively.

Figure 3A:
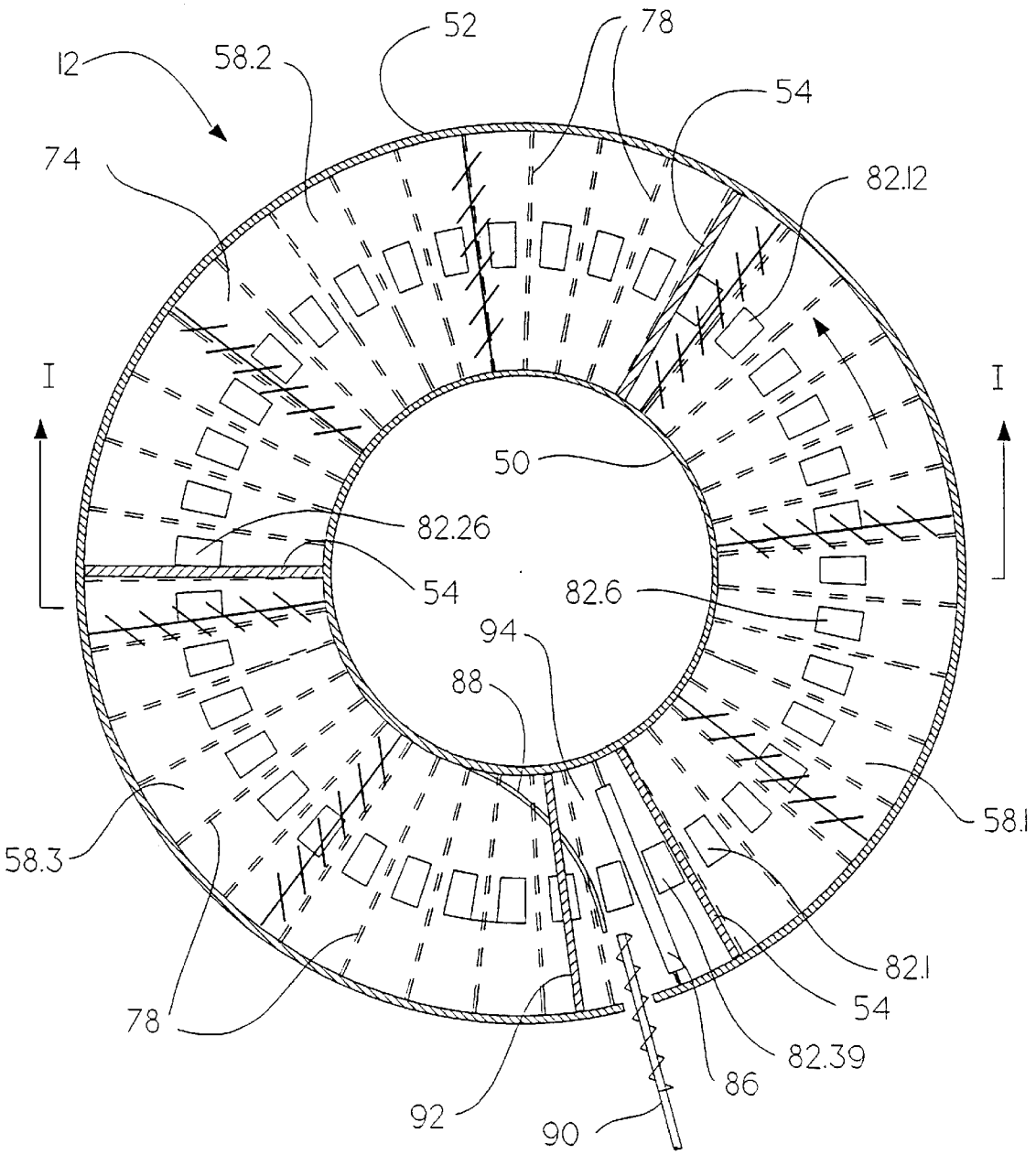
FIGS. 3*a* and 3*b* are plan views of different embodiments of the rotary hearth furnace taken along section lines III—III in FIG. 1.

With reference to FIG. 3*a* and with continuing reference to FIG. 1, the upper chamber 12 includes an inner cylindrical sidewall 50 and a concentric outer cylindrical sidewall 52. An annular roof 56 extends between upper edges of the inner cylindrical sidewall 50 and the outer cylindrical sidewall 52 and forms a seal therebetween. Positioned around the upper chamber 12 are a plurality of second baffles 54. The second baffles 54 extend downward from the annular roof 56 and between the inner sidewall 50 and the outer sidewall 52 in sealing engagement therewith to define a plurality of upper arcuate zones or plenums 58.1, 58.2 and 58.3.

The upper chamber 12 is positioned above and coaxially with base 10. Preferably, the first baffles 40 and the second baffles 54 are positioned in the respective base 10 and the upper chamber 12 so that the each of the lower plenums 42.1, 42.2 and 42.3 are aligned axially with a corresponding one of the upper plenums 58.1, 58.2 and 58.3. By this alignment, gas exhausted from each of the lower plenums 42.1, 42.2 and 42.3 is received in its corresponding axially aligned upper plenum 58.1, 58.2 and 58.3.

Each of the upper plenums 58.1, 58.2 and 58.3 includes an exhaust outlet 60 formed in the annular roof 56. Preferably, each of the upper plenums 58.1, 58.2 and 58.3 includes an exhaust outlet 60. The exhaust outlet 60 may be manifolded together to a common header 62 for exhausting heated gas from the rotary furnace A when the heated gas in each upper plenum 58.1, 58.2 and 58.3 has the same temperature and composition. Otherwise, each exhaust outlet 60 is vented separately.

Figure 3B:
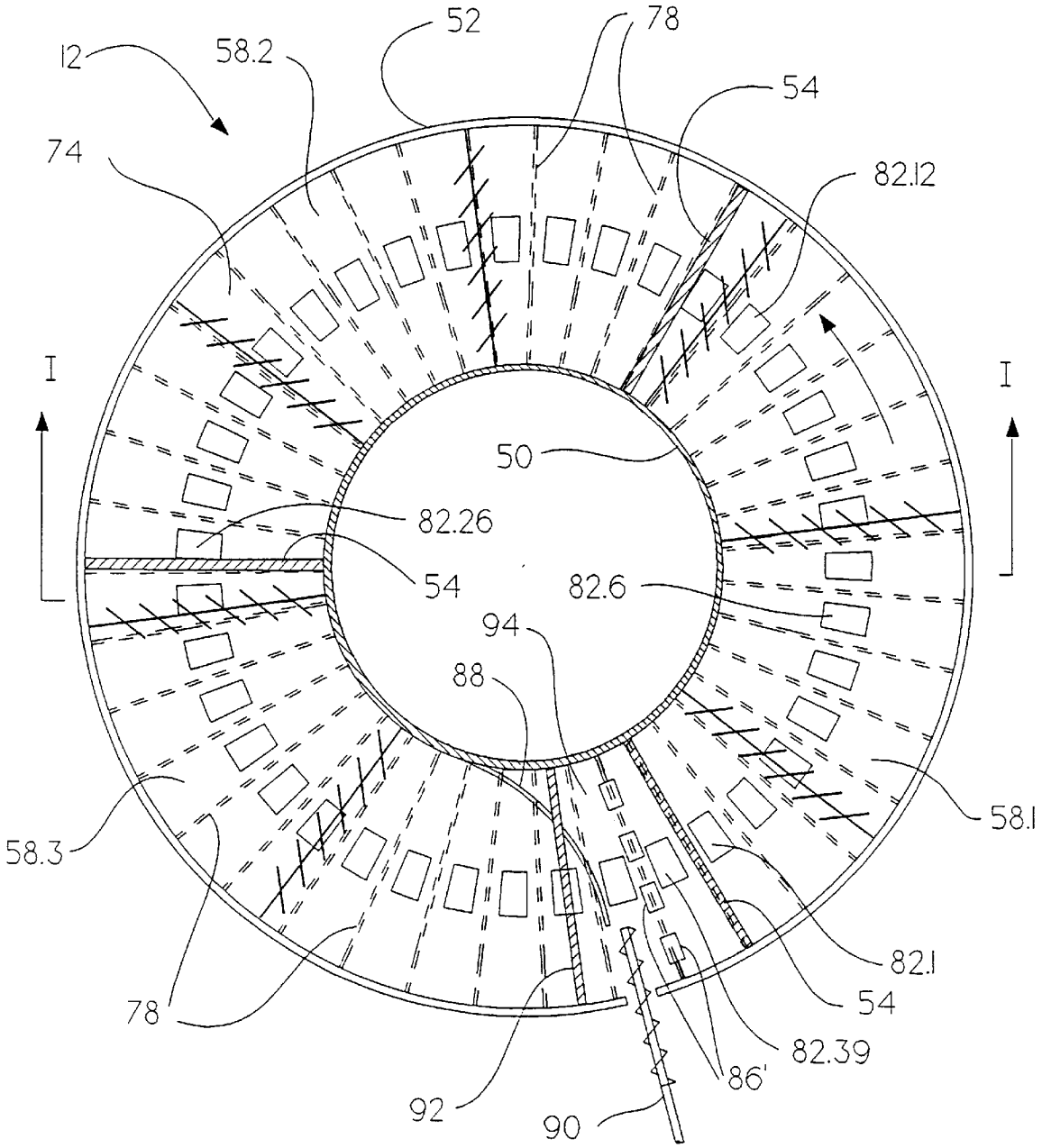
Figure 4:
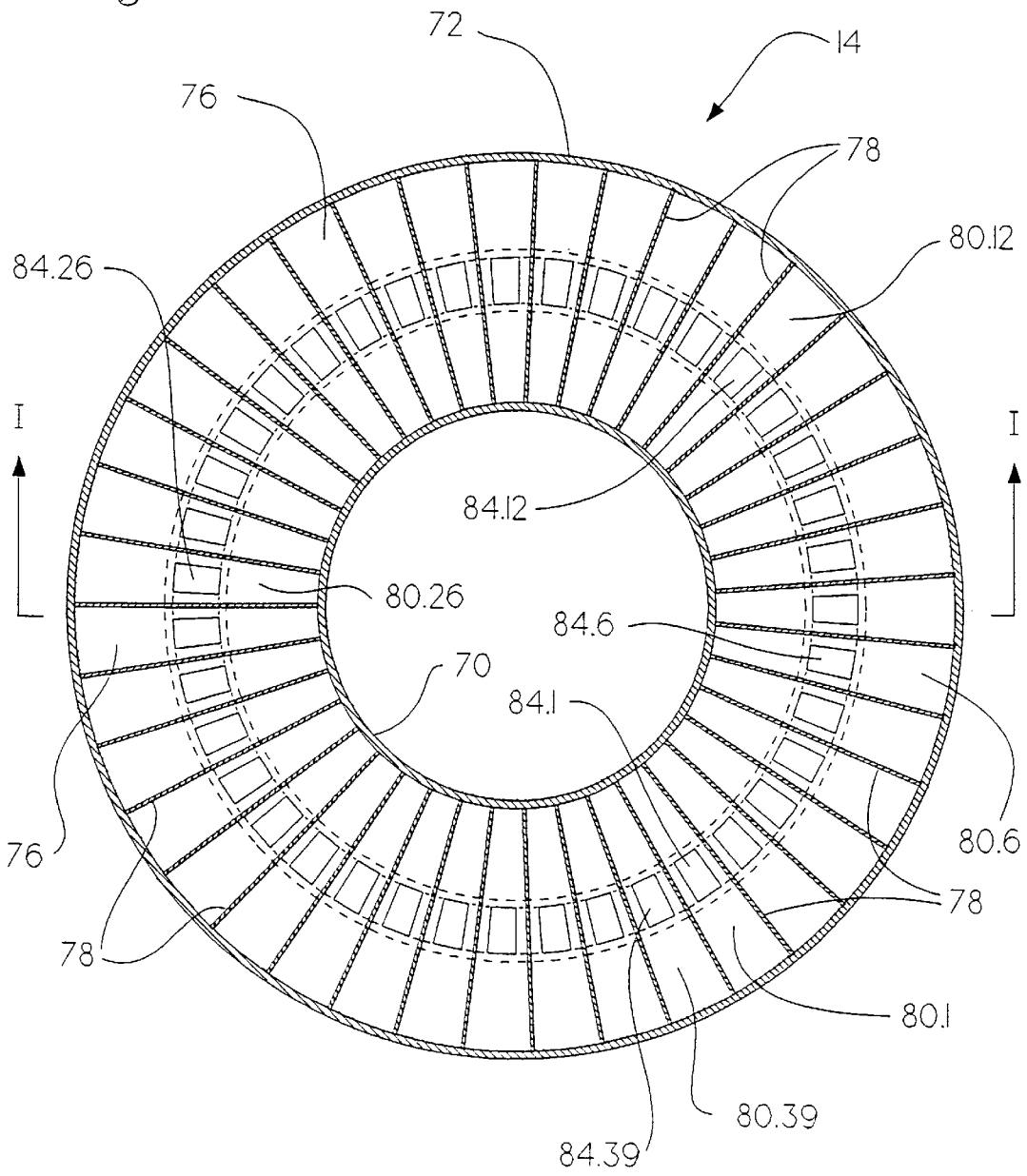
FIG. 4 is a sectional view of the rotary hearth furnace taken along section lines IV—IV of FIG. 1.

With reference to FIG. 4 and with continuing reference to FIGS. 1 and 3, the rotating hearth 14 includes an inner cylindrical sidewall 70 and a concentric outer cylindrical sidewall 72. As shown in FIGS. 1 and 3, an annular grate 74 extends between the inner cylindrical sidewall 70 and the outer cylindrical sidewall 72. The annular grate 74 is shown as extending horizontally between an upper extent of the inner cylindrical sidewall 70 and an upper extent of the outer cylindrical sidewall 72. Alternatively, the annular grate 74 could be slanted from an upper extent of the inner cylindrical sidewall 70 downwardly to the outer cylindrical sidewall 72, or vice versa.

As shown in FIGS. 1 and 4, the hearth 14 has an annular floor 76 affixed between the lower edges of the inner cylindrical sidewall 70 and the outer cylindrical sidewall 72. A plurality of third baffles 78 are positioned uniformly around the rotating hearth 14. Each of the third baffles 78 is affixed in sealing engagement between the grate 74, the annular floor 76, the inner sidewall 70 and the outer sidewall 72, thereby defining a plurality of intermediate plenums 80.1, 80.2, . . . 80.39 positioned between the lower plenums 42.1, 42.2 and 42.3 and the upper plenums 58.1, 58.2 and 58.3.

Figure 9:
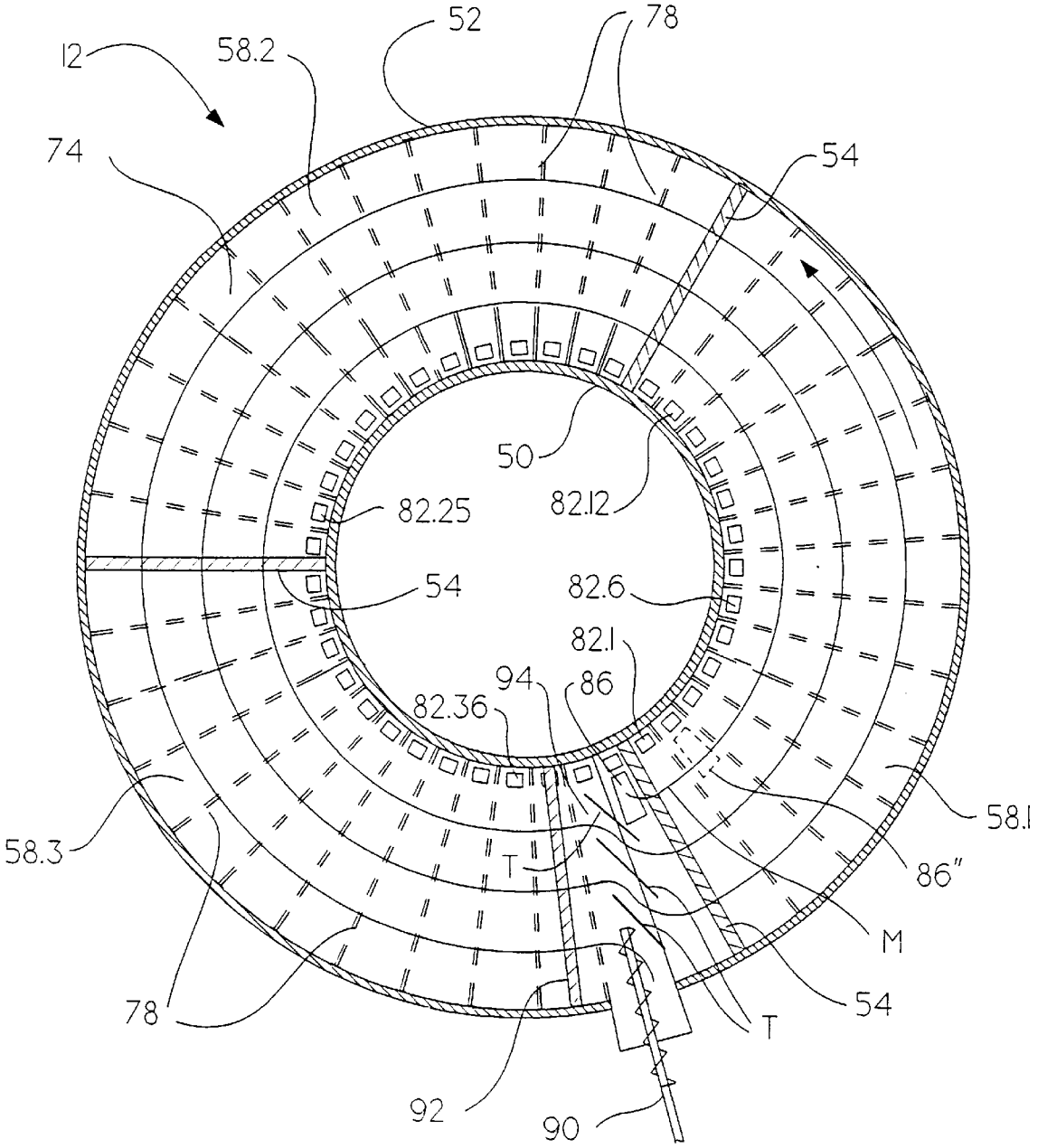
FIG. 9 is a plan view of a section of an upper chamber of a rotary hearth furnace in accordance with the resent invention.

The hearth 14 is rotatable between the base 10 and the upper chamber 12 on rollers or wheel 79 positioned between the hearth 14 and the base 10. The hearth 14 is, preferably, rotated by a variable speed motor driving a pinion through a gear reducing unit. The motor, pinion and gear reducing unit are best seen in FIG. 9, to be discussed hereinafter.

As best seen in FIG. 3*a*, the grate 74 has exhaust outlets 82.1, 82.2, . . . 82.39 formed therein between adjacent third baffles 78 (shown as dashed lines in FIG. 3*a*). Moreover, as best seen in FIG. 4, the floor 76 of the hearth 14 has inlet ducts 84.1, 84.2, . . . 84.39 formed therein between adjacent third baffles 78. Hence, each of the intermediate plenums 80.1, 80.2, . . . 80.39 has a corresponding inlet duct 84.1, 84.2, . . . 84.39 and exhaust outlet 82.1, 82.2, . . . 82.39. As best seen in FIG. 1, the inlet ducts 84.1, 84.2, . . . 84.39 of the hearth 14 extend downwardly towards the base 10 and in alignment with the upwardly extending annular channels 34.1, 34.2 and 34.3 of the base 10. Preferably, the lower edges of the inlet ducts 84.1, 84.2, . . . 84.39 are positioned closely adjacent the upper edges of the annular channels 34.1, 34.2 and 34.3.

The exhaust outlets 82.1, 82.2, . . . 82.39 of the grate 74 preferably include suitable barriers (not shown) that allow heated gas to pass therethrough while preventing material M being processed on the grate 74 from passing through the exhaust outlets 82.1, 82.2, . . . 82.39 and into one or more of the intermediate plenums 80.1, 80.2, . . . 80.39. Alternatively, the exhaust outlets 82.1, 82.2, . . . 82.39 of the grate 74 can be formed from a plurality of partially overlapping concentric flanges separated by spacers positioned between adjacent flanges, as illustrated in U.S. Pat. No. 4,669,977 to Johnson et al., expressly incorporated herein by reference.

With ongoing reference to FIG. 3*a*, a stationary feed chute 86 is positioned above the rotatable hearth 14 to feed material M to be processed onto the grate 74. A stationary discharge rabble 88 is positioned to engage material on the grate 74 as the hearth 14 is rotated relative to the discharge rabble 88. The discharge rabble 88 urges the material on the grate 74 towards a discharge screw 90. The discharge screw 90 is driven by a suitable drive (not shown) in a manner which actively removes the material M from the grate 74. The discharge rabble 88 and the discharge screw 90 are positioned adjacent the feed chute 86 opposite the direction of rotation of the hearth 14 (counterclockwise in FIG. 3). By this positioning, material M introduced on the hearth 14 is rotated substantially once around the furnace A before being discharged from the grate 74. Alternatively, as shown in FIG. 3*b*, a plurality of stationary feed chutes 86' may be positioned over the grate 74. Each of the plurality of feed chutes 86' is disposed at a radially different position to enable concentric paths of material M to be deposited on the grate 74.

Referring back to FIG. 3*a*, the upper chamber 12 includes an auxiliary baffle 92 positioned adjacent the discharge screw 90 opposite the feed chute 86. The auxiliary baffle 92 is affixed in sealing engagement between the concentric sidewalls 50, 52 and the roof 56 of the upper chamber 12. The auxiliary baffle 92 and the second baffle 54 positioned adjacent the feed chute 86 opposite the discharge screw 90 cooperate to define a discharge zone 94 wherein the introduction of heated gas is impeded. As shown in FIG. 2*a*, the part of the arcuate channel 34.3 axially aligned with the discharge zone 94 has an elongated deflecting plate 95 affixed between the top edges of opposing arcuate segments 30.3–32.3. The elongated deflecting plate 95 impedes the flow of heated gas from the lower arcuate plenum 42.3 upwards towards the discharge zone 94. Alternatively, the cover plate 38 can be elongated and the arcuate channel 34.3 modified so that the end plate 36 is axially aligned with the auxiliary baffle 92. In yet another alternative, shown in phantom in FIG. 2*a*, the deflecting plate 95 or the cover plate 38 is elongated in a direction opposite the direction of rotation of the hearth 14. This later arrangement provides time for gas introduced into each of the intermediate plenums 80.1, 80.2, . . . 80.39 via the lower arcuate plenum 42.3 to vent into axially aligned upper arcuate plenum 58.3 before reaching the discharge zone 94. Hence, little or no treatment gas is introduced into the discharge zone 94.

As shown in FIG. 1, the lower or distal edges of the second baffles 54 are spaced from the grate 74 a distance sufficient to permit material M deposited on the grate 74 to pass thereunder. In similar manner, the lower edges of the auxiliary baffle 92 are spaced from the grate 74 a distance sufficient to permit material M deposited on the grate 74 to pass thereunder.

Seals 96, 96' are located between (i) the rotating hearth 14 and the stationary base 10 and (ii) the rotating hearth 14 and the stationary upper chamber 12, respectively. The seals 96, 96' may include a sealing medium, such as water, coke fines, oil, sand, and the like, capable of impeding heated gas from flowing therethrough at the gas pressures and temperatures being utilized for treating the material M on the grate 74.

Figure 5A:
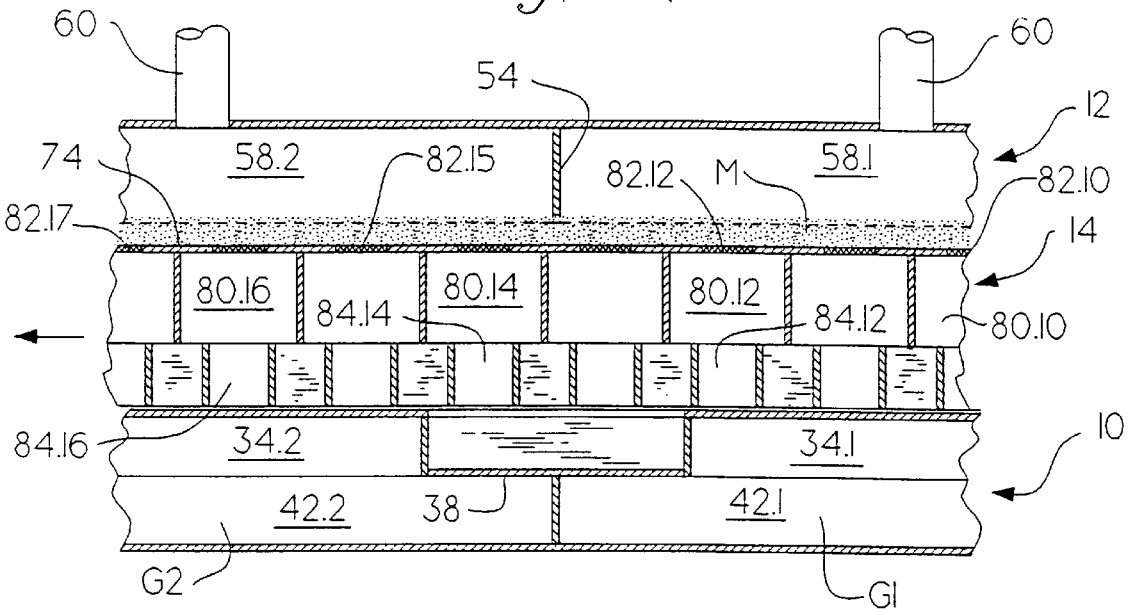
FIGS. 5*a*–5*d* are cross-sectional views of the rotary hearth furnace of FIG. 1 showing movement of the hearth between the stationary base and the stationary upper chamber.

With reference to FIGS. 5*a*–5*d*, a cross-section of the hearth 14 is illustrated moving between stationary cross-sections of the base 10 and the upper chamber 12. In FIG. 5*a*, a first gas G1 is introduced into the lower arcuate plenum 42.1 at a sufficient pressure to cause the gas to be dispersed throughout the lower arcuate plenum 42.1. Similarly, a second gas G2 is introduced into the lower arcuate plenum 42.2 at a sufficient pressure to cause the gas to be dispersed throughout the lower arcuate plenum 42.2. The first gas G1 rises upwards through arcuate channel 34.1 and into the intermediate plenums 80.10, 80.11 and 80.12. Similarly, the second gas G2 rises upwards through arcuate channel 34.2 and into the intermediate plenums 80.15, 80.16 and 80.17. The first gas G1 entering the intermediate plenums 80.10, 80.11 and 80.12 rises upwards through the exhaust outlets 82.10, 82.11 and 82.12 associated therewith, through material M deposited on grate 74, and into the axially aligned upper plenum 58.1. Similarly, the second gas G2 entering the intermediate plenums 80.15, 80.16 and 80.17 rises upwards through the exhaust outlets 82.15, 82.16 and 82.17 associated therewith, through material M deposited on grate 74 and into axially aligned upper plenum 58.2.

The exhaust outlets 60 of the upper plenums 58.1 and 58.2 are sized to impede the flow of the first gas G1 and the second gas G2 therethrough. This, in turn, produces in the upper plenums 58.1 and 58.2 a gas pressure that urges the first gas G1 and second gas G2 into contact with the material M and, more specifically, into the body of material M, thereby enhancing the exposure of material M to the first gas Gi and the second gas G2.

Preferably, the first gas G1 and the second gas G2 are not commingled and material M is not exposed simultaneously to the first gas G1 and the second gas G2. However, as noted previously, the second baffles 54 have lower edges spaced above the grate 74 a distance sufficient to permit the material M to pass thereunder. This space, while permitting material M to pass, also allows some commingling of the first gas G1 and the second gas G2 and simultaneous exposure of material M to the first gas G1 and the second gas G2. To minimize such commingling and simultaneous exposure, the gas pressure in adjacent upper plenums, e.g., 58.1 and 58.2, is preferably regulated to be the same to inhibit gas flow therebetween.

In FIG. 5*a*, the inlet ducts 84.13 and 84.14 of the intermediate plenums 80.13 and 80.14 are positioned in a 'dead' space above the cover plate 38 and between the arcuate channels 34.1 and 34.2. In this 'dead' space, residual gas in the intermediate plenums 80.13 and 80.14 is allowed to escape to the upper plenums 58.1, 58.2 and 58.3 in the absence of fresh gas, e.g., gas G1, being introduced into the intermediate plenums 80.1, 80.2, . . . , 80.39. To further enable the gas trapped in the intermediate plenums 80.13 and 80.14 to rise into the upper plenums 58.1, 58.2 and 58.3, each 'dead' space includes a gas inlet (not shown) for introducing a desired purging medium, such as an inert gas, into the 'dead' space.

Figure 5B:
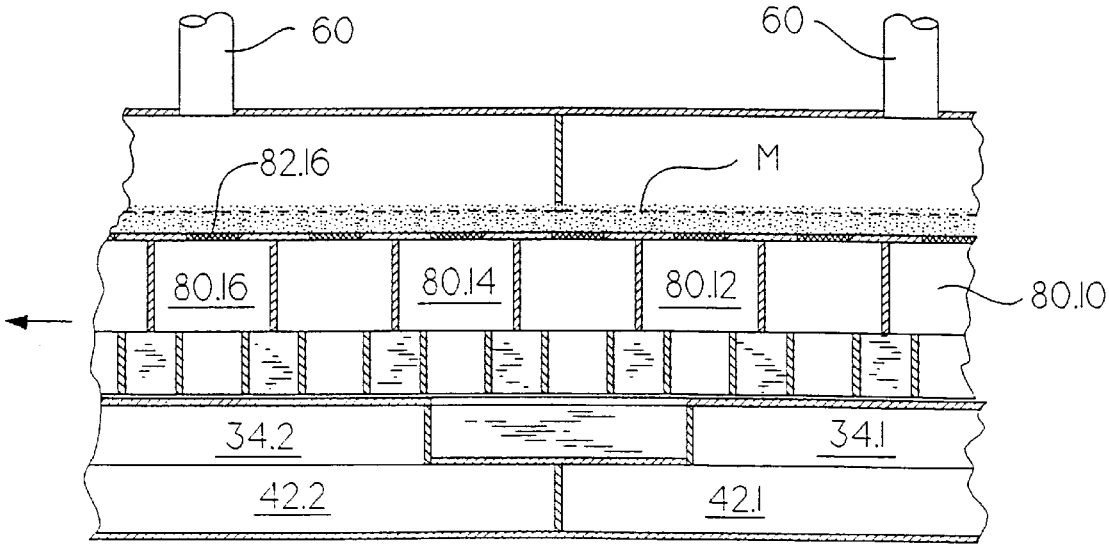
Figure 5C:
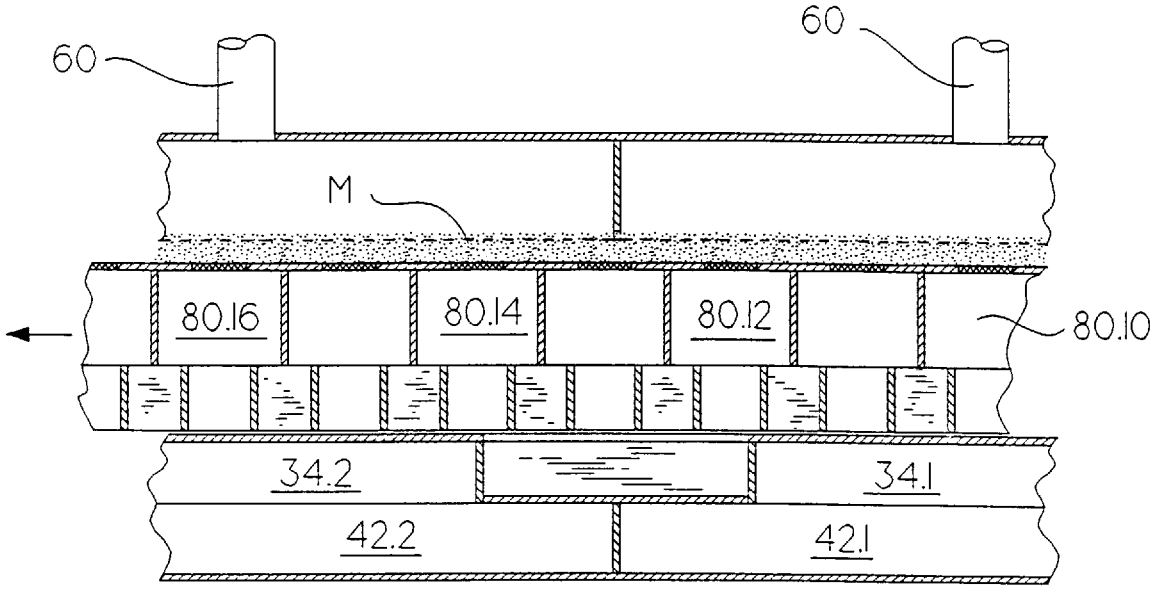

In FIGS. 5*b*–5*c*, continued movement of the hearth 14 relative to the base 10 and the upper chamber 12, e.g., to the left in FIG. 5*b*, progressively shifts the intermediate plenum 80.12 into decreasing fluid communication with the arcuate channel 34.1 and into increasing fluid communication with the 'dead' space between adjacent arcuate channels 34.1 and 34.2. Simultaneously, the intermediate plenum 80.14 is progressively shifted into increasing fluid communication with the arcuate channel 34.2.

Figure 5D:
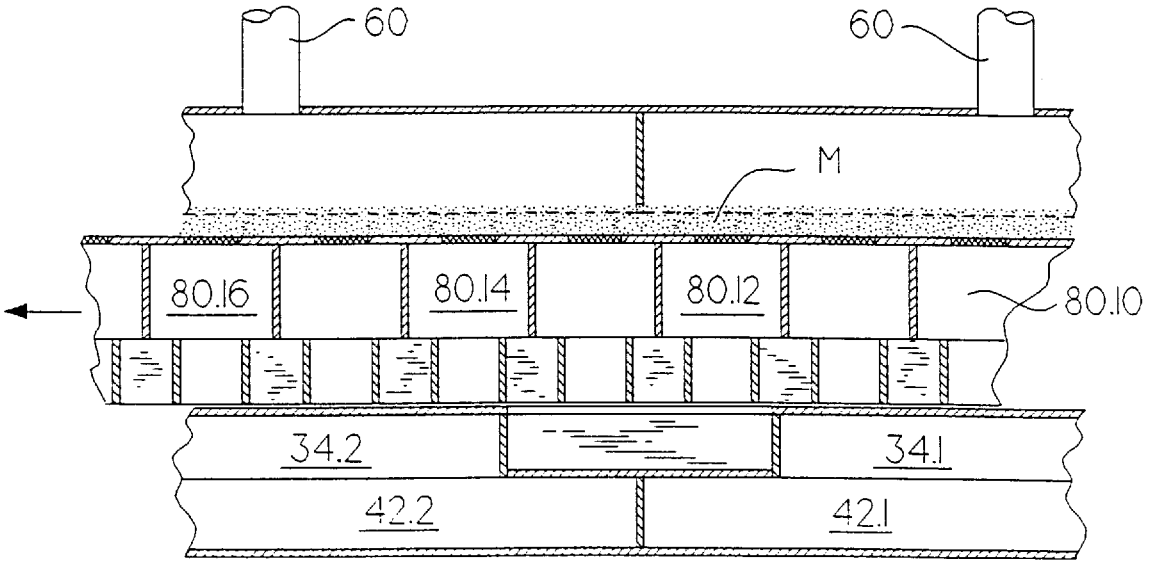

In FIG. 5*d*, further movement of the hearth 14 moves the intermediate plenum 80.12 into fluid communication with the 'dead' space between adjacent lower plenums 42.1 and 42.2. Simultaneously, the inlet duct 84.14 of the intermediate plenum 80.14 moves into fluid communication with arcuate channel 34.2.

The above described movement of the hearth 14 continues in a manner so that each of the intermediate plenums 80.1, 80.2, . . . , 80.39 sequentially moves: (i) into fluid communication with the arcuate channel 34.1; (ii) out of fluid communication with the arcuate channel 34.1 and into fluid communication with the 'dead' space between arcuate channels 34.1 an 34.2; (iii) out of fluid communication with the 'dead' space between arcuate channels 34.1 an 34.2 and into fluid communication with the arcuate channel 34.2; (iv) out of fluid communication with the arcuate channel 34.2 and into fluid communication with the 'dead' space between arcuate channels 34.2 and 34.3; (v) out of fluid communication with the 'dead' space between arcuate channels 34.2 and 34.3 and into fluid communication with the arcuate channel 34.3; (vi) out of fluid communication with the arcuate channel 34.3 and into fluid communication with the 'dead' space between arcuate channels 34.3 and 34.1, i.e., the discharge zone 94, and (vii) out of fluid communication with the 'dead' space between arcuate channels 34.3 and 34.1 and back into fluid communication with the arcuate channel 34.1.

Figure 6:
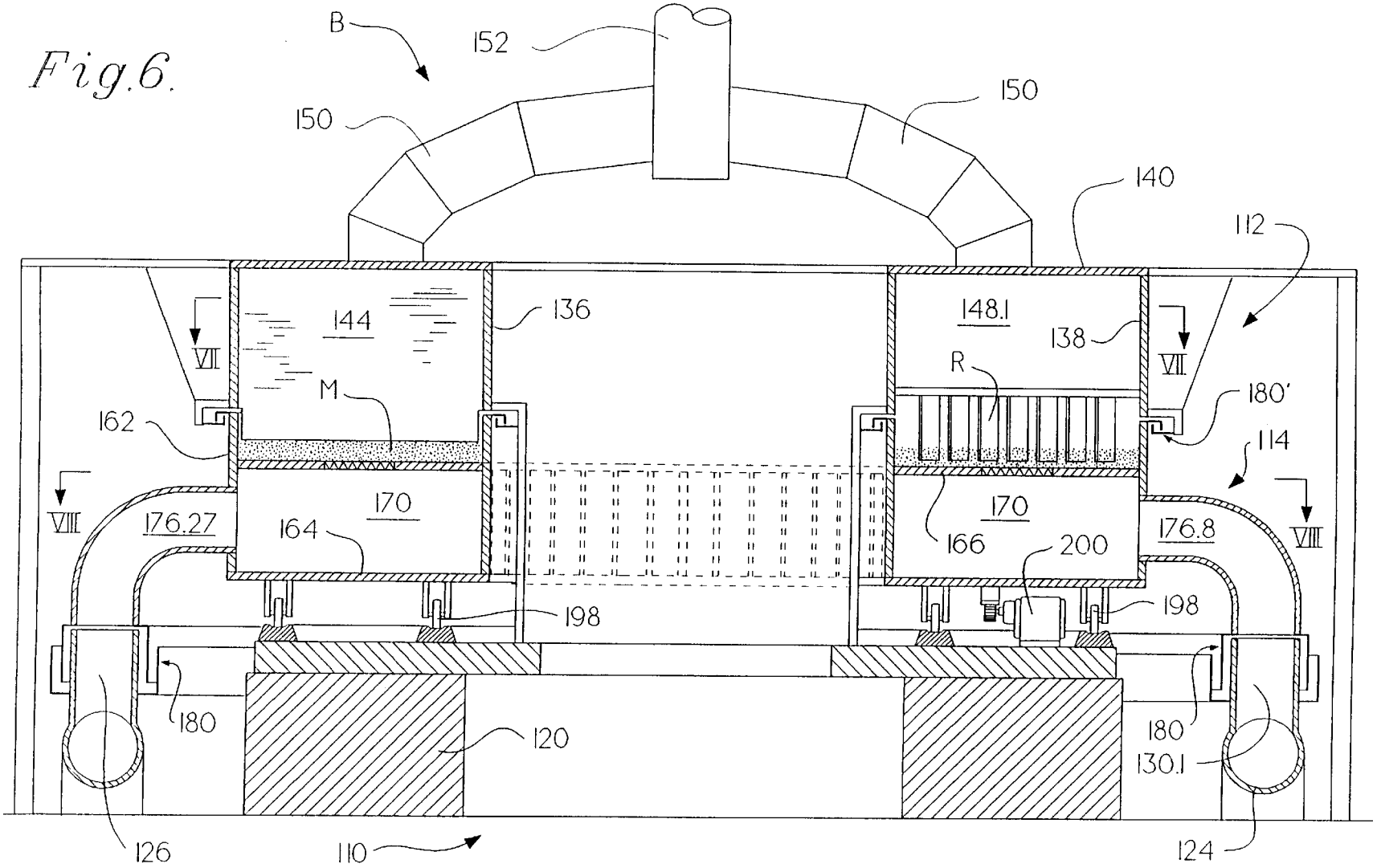
FIG. 6 is an elevational sectional view of a rotary hearth furnace having a base that has an inside diameter that is greater than the outside diameter of the hearth and has a plurality of conduits extending between plenums of the hearth and arcuate plenums of the base.
Figure 7:
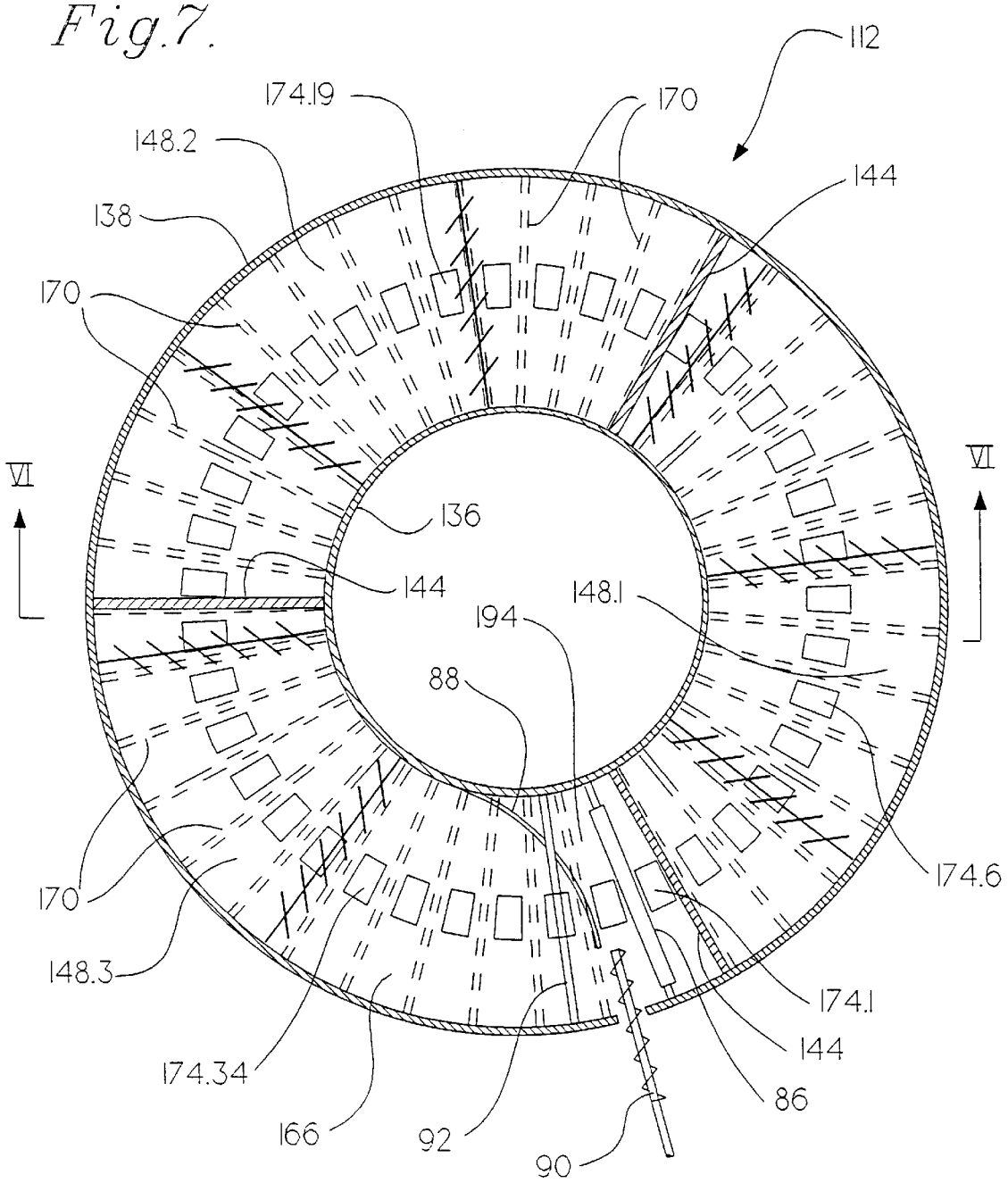
FIG. 7 is a plan view of the rotary hearth furnace taken along section lines VII—VII in FIG. 6.
Figure 8:
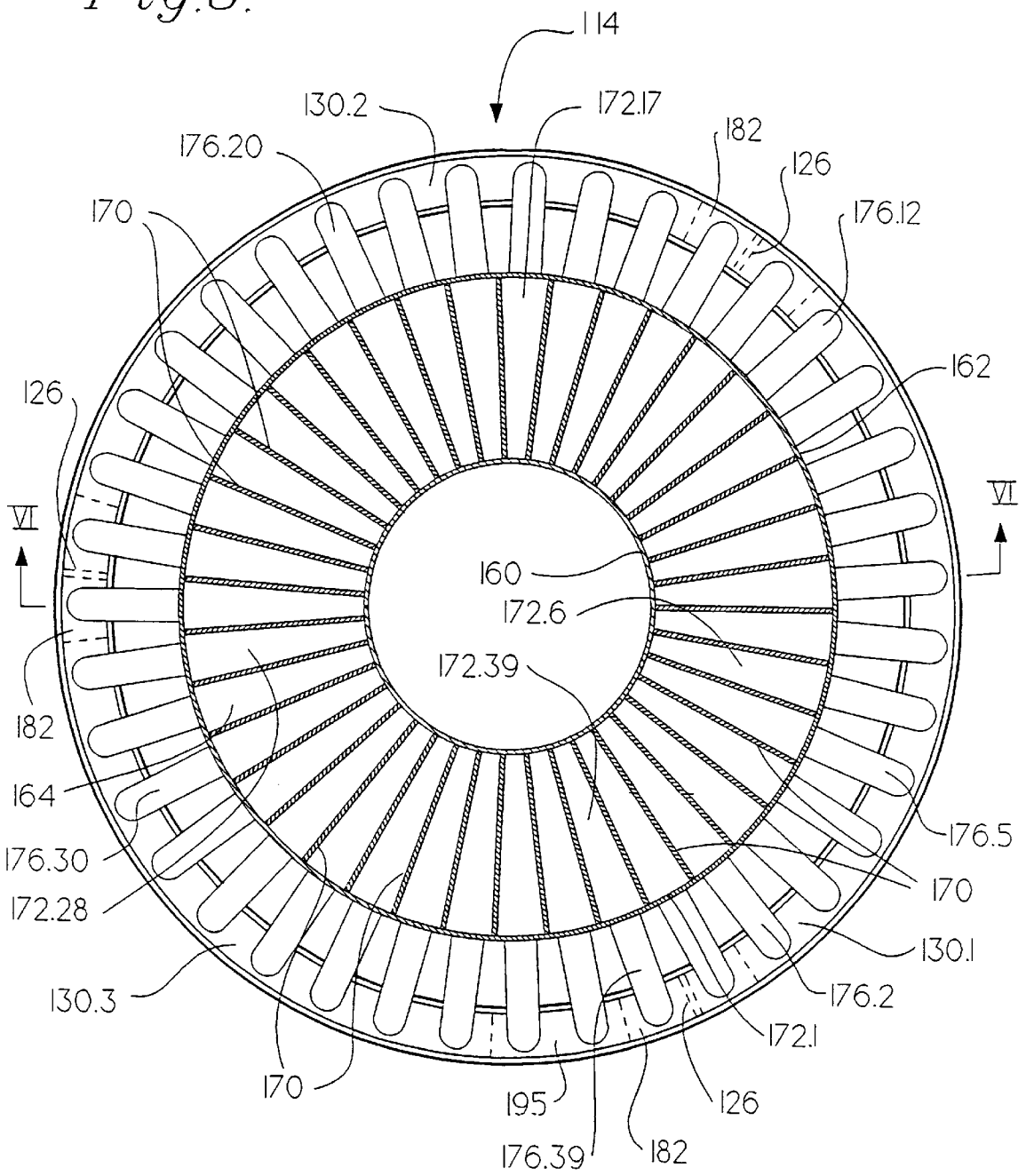
FIG. 8 is a plan view of the rotary hearth furnace taken along section lines VIII—VIII in FIG. 6.

With reference to FIGS. 6–8, in another embodiment, a sealed rotary furnace B has a stationary base 110 and a stationary upper chamber 112 positioned coaxial to the base 110 and a rotating hearth 114 positioned between the upper chamber 112 and the base 110 and coaxial therewith. In this embodiment, the outside diameter of the base 110 is greater than the outside diameter of the hearth 114.

The base 110 has an annular support 120 and an annular lower channel 124 positioned outside the annular support 120 and concentric therewith. The lower channel 124 has an annular opening that debouches upwardly.

As shown in FIG. 8, the lower channel 124 includes a plurality of baffles 126 (shown in phantom) positioned therein. The baffles 126 divide the annular lower channel 124 into a plurality of lower arcuate zones or plenums 130.1, 130.2 and 130.3 that are sealed from each other. A common or different gas is introducible into each of the arcuate plenums 130.1, 130.2 and 130.3 via a gas inlet (not shown) and is exhausted therefrom via the arcuate opening of each of arcuate plenums 130.1, 130.2 and 130.3.

With reference back to FIGS. 6 and 7, the upper chamber 112 includes an inner cylindrical sidewall 136 and a concentric outer cylindrical sidewall 138. An annular roof 140 extends between upper edges of the inner cylindrical sidewall 136 and the outer cylindrical sidewall 138 and forms a seal therebetween. Positioned around the upper chamber 112 are a plurality of baffles 144. These baffles 144 extend downward from the annular roof 140 and between the inner sidewall 136 and the outer sidewall 138 to define a plurality of upper arcuate zones or plenums 148.1, 148.2 and 148.3. Each of the upper plenums 148.1, 148.2 and 148.3 is, preferably, axially aligned with a corresponding one of the lower plenums 130.1, 130.2 and 130.3. As shown in FIG. 6, each of the upper plenums 148.1, 148.2 and 148.3 includes an exhaust outlet 150 formed in the annular roof 140. These exhaust outlets 150 may be manifolded together to a common header 152 or may be vented separately. The upper chamber 112 is similar to the upper chamber 12 of FIGS. 1 and 3.

As shown in FIGS. 6 and 8, the hearth 114 includes an inner cylindrical sidewall 160 and an outer cylindrical sidewall 162 concentric with the inner sidewall 160. A floor 164 extends between a lower edge of the inner sidewall 160 and a lower edge of the outer sidewall 162. An annular grate 166 extends between an upper extent of the inner cylindrical sidewall 160 and an upper extent of the outer cylindrical sidewall 162. A plurality of baffles 170 are positioned in sealing engagement around the hearth 114 defining a plurality of intermediate plenums 172.1, 172.2, . . . 172.39. As best seen in FIG. 7, the grate 166 has exhaust outlets 174.1, 174.2, . . . , 174.39 formed therein between adjacent baffles 170 (shown in phantom in FIG. 7). The baffles 144 of the upper chamber 112 have lower or distal edges that are spaced from the grate 166 a distance sufficient to permit material M deposited on the grate 166 to pass thereunder.

Each of the intermediate plenums 172.1, 172.2, . . . 172.39 includes a conduit 176.1, 176.2, . . . , 176.39 affixed to the outer cylindrical sidewall 162 of the hearth 114. Each conduit 176.1, 176.2, . . . , 176.39 extends radially from the outer cylindrical sidewall 162 and terminates at a distal end positioned in opposition with the openings of arcuate plenums 130.1, 130.2 and 130.3 of the base 110.

Seals 180, 180' are located between (i) the distal ends of the conduits 176.1, 176.2, . . . 176.39 and the arcuate plenums 130.1, 130.2 and 130.3 and (ii) the rotating hearth 114 and the stationary upper chamber 112, respectively. Preferably, the seals 180 between the distal ends of the conduits 176.1, 176.2, . . . 176.39 and the arcuate plenums 130.1, 130.2 and 130.3 extend circumferentially between adjacent conduits 176.1, 176.2, . . . 176.39.

As shown in FIG. 8, cover plates 182 are preferably positioned over the openings between adjacent arcuate plenums 130.1, 130.2 and 130.3 to create a barrier therebetween where gas is impeded from entering into the intermediate plenums 172.1, 172.2, . . . 172.39 passing thereover.

As shown in FIG. 7, the furnace B preferably includes a stationary feed chute 86, a stationary discharge rabble 88, a discharge screw 90 and an auxiliary baffle 92 that operate in the manner set forth above for like numbered elements in the embodiment shown in FIGS. 1 and 3. A discharge zone 194 is defined in the upper chamber 112 between the auxiliary baffle 92 and the baffle 144 positioned adjacent the feed chute 86. As shown in FIG. 8, the arcuate plenum 130.3 axially aligned with the discharge zone 94 has an elongated deflecting plate 195 affixed to the open end thereof for impeding the flow of heated gas into the conduits 176.1, 176.2, . . . 176.39 moving into alignment with the discharge zone 194 of FIG. 7.

In operation, the hearth 114 is rotated between the stationary upper chamber 112 and the annular support 120 on rollers or wheels 198 positioned between the hearth 114 and the annular support 120. The hearth 114 is, preferably, rotated by a combination variable speed motor and pinion and gear reducing unit 200. Because they are affixed to the outer sidewall 162 of the hearth 114, the conduits 176.1, 176.2, . . . 176.39 extend radially from the hearth 114 and rotate therewith. The conduits 176.1, 176.2, . . . 176.39 enable gas to flow from the plenums 130.1, 130.2 and 130.3 into the intermediate plenums 172.1, 172.2, . . . 172.39 via the sidewall 162 of the hearth 114 as the hearth 114 is rotated between the upper chamber 112 and the annular support 120. This is contrasted to the embodiment shown in FIG. 1, wherein the base 10 has the same inside diameter as the hearth 14 and the upper chamber 12, and gas flows upwards from the base 10 into intermediate plenums 80.1, 80.2, . . . 80.39 of the hearth 14 via ducts 84.1, 84.2, . . . 84.39 located in the floor 76 of the hearth 14.

In the embodiment of FIGS. 6–8, once gas enters the intermediate plenums 172.1, 172.2, . . . 172.39, the operation of this later embodiment is similar to the embodiment shown in FIG. 1.

In each of the above-described embodiments, one or more mixing rabbles R are suspended above the moveable hearth. Each rabble R has a distal edge positioned closely adjacent the surface of the grate opposite the plurality of third plenums for engaging the material M deposited on the grate as the grate is moved relative to the rabbles R. The rabbles R cause the material M to be mixed thereby engendering exposure of the material M to treatment gases.

With reference to FIGS. 4 and 9, in another embodiment, the exhaust outlets 82.1, 82.2, . . . 82.39 are formed in the annular grate adjacent the inner cylindrical sidewall 70 or the outer cylindrical sidewall 72. The stationary feed chute 86, which spans only a portion of the grate 74, is positioned adjacent one of the exhaust outlets, e.g., 82.39, opposite the sidewall 70 or 72. One or more stationary transport rabbles T are positioned to engage and transport radially material M that has been deposited on the grate 74 via the feed chute 86. More specifically, material M deposited on the grate 74 is rotated thereon (counterclockwise in FIG. 9) and into engagement with the transport rabbles T which progressively urge the material M radially, outward in FIG. 9, and into engagement with the discharge screw 90.

A second stationary feed chute 86", shown in phantom in FIG. 9, may be positioned in the path of material M deposited via stationary feed chute 86. The second stationary feed chute 86' can be utilized to deposit additional material M' on the material M deposited on the grate 74 via chute 86. The two feed chutes 86, 86" enable different materials or materials having different properties, e.g., mesh size, to be deposited sequentially on the grate 74 with the material M' deposited via the chute 86" being deposited on the material M deposited by the chute 86.

The above invention has been described with reference to the preferred embodiments. Obvious modifications and alterations will occur to others upon reading and understanding the preceding detailed description. For example, combinations of transport rabbles and mixing rabbles may be utilized. It is intended that the invention be construed as including all such modifications and alterations insofar as they come within the scope of the appended claims or the equivalents thereof.

What is claimed is:

1. A furnace for drying and heating particulate material, the furnace comprising:

a base having a plurality of first plenums, each of the first plenums having a gas inlet and a gas outlet;

an upper chamber having a plurality of second plenums, each of the second plenums aligned to receive gas from the gas outlet of one of the first plenums; and a hearth positioned between the base and the upper chamber and moveable therebetween, the hearth including a grate and a plurality of third plenums positioned between the grate and the first plenums, the grate defining an exhaust opening for each of the third plenums, with at least two adjacent plenums of the plurality of third plenums being positionable to receive gas from the gas outlet of one of the first plenums and to exhaust gas through the exhaust openings thereof to the second plenum.

2. The furnace as set forth in claim 1 wherein the grate is formed from a plurality of overlapping plates separated by spacers positioned between the overlapping plates, the spacers and the overlapping plates coacting to define the opening for each plenum of the third plurality of plenums.

3. The furnace as set forth in claim 1 wherein the second plenums are in alignment with the first plenums.

4. The furnace as set forth in claim 1 further including a plurality of rabbles fixedly positioned relative to the moveable hearth, each rabble having a distal edge positioned adjacent a surface of the grate opposite the plurality of third plenums for engaging the particulate material deposited thereon as the grate moves relative to the rabbles.

5. The furnace as set forth in claim 1 further including one or more feed chutes for feeding the particulate material onto the grate.

6. The furnace as set forth in claim 1 further including at least one of a discharge rabble and a discharge screw positioned adjacent the surface of the grate for engaging the particulate material deposited thereon and for discharging the engaged particulate material from the furnace.

7. The furnace as set forth in claim 1 wherein each of the second plenums is defined by a pair of baffles positioned transverse to the direction of movement of the grate, each baffle having a distal edge spaced from the grate a distance sufficient to permit material deposited on the grate to pass between the grate and the distal edge of the baffles.

8. The furnace as set forth in claim 4 wherein the plurality of rabbles are comprised of at least one of transport rabbles and mixing rabbles.

9. The furnace as set forth in claim 5 wherein two feed chutes are positioned to deposit the particulate material on the grate along one of (i) the same path and (ii) different paths.

10. A moveable hearth furnace comprising:

a first lower plenum having a gas outlet;

a first upper plenum having a gas inlet; and a hearth positionable between the first lower plenum and the first upper plenum and moveable therebetween, the hearth including a grate having a surface for supporting material being processed and a pair of adjacent plenums positioned between the grate and the first lower plenum, the grate defining an opening for each plenum of the pair of adjacent plenums for exhausting gas therefrom, with each of the pair of adjacent plenums positionable to receive gas from the gas outlet of the first lower plenum and to direct the received gas to the gas inlet of the first upper plenum via the opening in the grate.

11. The furnace as set forth in claim 10 further including:

a second lower plenum positioned adjacent the first lower plenum, the second lower plenum having a gas outlet;

a second upper plenum positioned adjacent the first upper plenum, the second upper plenum having a gas inlet; and a baffle positioned between the first lower plenum and the second lower plenum and coacting therewith so that each of the adjacent plenums of the hearth receives gas from the gas outlet of only one of the first lower plenum and the second lower plenum as it is moved from fluid communication with the first lower plenum to fluid communication with the second lower plenum.

12. The furnace as set forth in claim 11 wherein:

the first lower plenum has a first gas inlet for receiving a first gas and the second lower plenum has a second gas inlet for receiving a second gas; and the first upper plenum has a first gas outlet and the second upper plenum has a second gas outlet.

13. The furnace as set forth in claim 12 wherein the first gas and the second gas are different.

14. The furnace as set forth in claim 12 wherein the first gas outlet and the second gas outlet are connected to an exhaust header.

15. The furnace as set forth in claim 11 further including a plurality of rabbles having distal edges positioned adjacent the surface of the grate for shifting the material being processed thereon as the hearth moves relative to the rabbles.

16. The furnace as set forth in claim 11 wherein the first lower plenum and the second lower plenum are in alignment with the respective first upper plenum and the second upper plenum.

17. A rotary hearth furnace comprising:

an annular gas inlet header having a first pair of concentric side walls and a plurality of first partitions positioned around the gas inlet header and extending between the first pair of side walls, the plurality of first partitions and the first pair of side walls defining a first arcuate inlet zone for receiving a first gas and a second arcuate inlet zone for receiving a second gas, the first arcuate inlet zone having a first exhaust aperture for exhausting the first gas and the second arcuate inlet zone having a second exhaust aperture for exhausting the second gas;

an annular gas exhaust header positioned coaxial with the gas inlet header, the gas exhaust header having a second pair of concentric side walls and a plurality of second partitions positioned around the gas exhaust header and extending between the second pair of side walls, the plurality of second partitions and the second pair of side walls defining a first arcuate exhaust zone having an inlet aperture for receiving the first gas and a second arcuate exhaust zone having an inlet aperture for receiving the second gas; and a ring-shaped hearth positioned co-axially between the gas inlet header and the gas exhaust header and rotatable therebetween, the hearth including:

a third pair of concentric side walls and a plurality of third partitions positioned around the hearth and extending between the third pair of side walls, the plurality of third partitions and the third pair of side walls defining a plurality of intermediate arcuate zones, each of the intermediate arcuate zones having a gas inlet aperture for receiving gas from one of the first exhaust aperture and the second exhaust aperture; and a material processing grate positioned between the plurality of intermediate arcuate zones and the gas exhaust header and defining an outlet aperture for each of the plurality of intermediate arcuate zones for exhausting gas to the inlet aperture of one of the first arcuate exhaust zone and the second arcuate exhaust zone, wherein the plurality of intermediate arcuate zones channel the first gas between the first arcuate inlet zone and the first to arcuate exhaust zone and channel the second gas between the second arcuate inlet zone and the second arcuate exhaust zone as the hearth is rotated between the gas inlet header and the gas exhaust header.

18. The furnace as set forth in claim 17 further including a baffle positioned between the first arcuate inlet zone and the second arcuate inlet zone.

19. The furnace as set forth in claim 18 wherein the arcuate inlet zones, the baffle and the plurality of intermediate arcuate zones co-act to restrict the entry of gas into the intermediate arcuate zones moving between the first arcuate inlet zone and the second arcuate inlet zone.

20. The furnace as set forth in claim 17 wherein the first arcuate inlet zone is axially aligned with the first arcuate exhaust zone and the second arcuate inlet zone is axially aligned with the second arcuate exhaust zone.

21. The furnace as set forth in claim 17 wherein the inner diameter of the gas inlet header is greater than the outer diameter of the gas exhaust header.

22. The furnace as set forth in claim 21 further including conduits positioned between each of the intermediate arcuate zones and one of the first arcuate inlet zone and the second arcuate inlet zone for enabling gas to flow therebetween.

23. A rotary hearth furnace including:

a base having a plurality of first plenums;

an upper chamber having a plurality of second plenums; and a hearth rotatable between the base and the upper chamber, the hearth having a plurality of third plenums, with the hearth moveable between the base and the upper chamber so that at least two plenums of the plurality of third plenums are positionable to receive gas exhausted by one of the plurality-of first plenums and to discharge the received gas into one of the plurality of second plenums.

* * * * *

UNITED STATES PATENT AND TRADEMARK OFFICE

CERTIFICATE OF CORRECTION

PATENT NO. : 5,868,566

DATED : February 9, 1999

INVENTOR(S) : Beverly Earl Johnson and James P. Docherty

It is certified that error appears in the above-identified patent and that said Letters Patent is hereby corrected as shown below:

Column 3 Line 40 "resent" should read --present--.

Column 6 Line 67 "Gi" should read --G1--.

Column 12 Line 27 Claim 17 between "first" and "arcuate" delete --to--.

Column 12 Line 61 Claim 23 "plurality-of" should read --plurality of--.

Signed and Sealed this

Twenty-seventh Day of July, 1999

*Attest:*

*Attesting Officer*

Q. TODD DICKINSON

*Acting Commissioner of Patents and Trademarks*